US007303182B2

(12) United States Patent
Ash

(10) Patent No.: US 7,303,182 B2
(45) Date of Patent: Dec. 4, 2007

(54) SYSTEM FOR RAISING, LOWERING & PRECISION POSITIONING OF SURVEILLANCE, SECURITY AND COMMUNICATIONS EQUIPMENT

(75) Inventor: John T. Ash, Homer Glen, IL (US)

(73) Assignee: John Ash, Hormer Glen, IL (US)

( * ) Notice: Subject to any disclaimer, the term of this patent is extended or adjusted under 35 U.S.C. 154(b) by 513 days.

(21) Appl. No.: 10/684,763

(22) Filed: Oct. 14, 2003

(65) Prior Publication Data

US 2004/0084664 A1 May 6, 2004

Related U.S. Application Data

(60) Provisional application No. 60/422,131, filed on Oct. 30, 2002.

(51) Int. Cl.
*B66D 1/36* (2006.01)

(52) U.S. Cl. ..... 254/336; 248/221.11; 248/222.11; 248/222.13

(58) Field of Classification Search ..... 254/338, 254/262, 336; 343/853, 890; 248/221.11, 248/222.11, 222.12, 222.13
See application file for complete search history.

(56) References Cited

U.S. PATENT DOCUMENTS 4,334,337 A * 6/1982 Miller et al. ..... 15/326
4,647,015 A * 3/1987 Pusl ..... 254/230
5,787,673 A * 8/1998 Noble ..... 52/726.1
5,995,063 A * 11/1999 Somoza et al. ..... 343/890
6,052,092 A * 4/2000 Davis et al. ..... 343/757
6,123,314 A * 9/2000 Steele ..... 248/681
6,342,870 B1 * 1/2002 Mehrkens et al. ..... 343/891
6,612,088 B1 * 9/2003 Damiano ..... 52/736.4
6,631,885 B2 * 10/2003 Halas ..... 254/225
6,710,751 B2 * 3/2004 Ianello et al. ..... 343/890
6,768,473 B2 * 7/2004 Harland et al. ..... 343/890
6,929,226 B1 * 8/2005 Philistine ..... 248/222.52

* cited by examiner

*Primary Examiner*—Emmanuel M Marcelo
(74) *Attorney, Agent, or Firm*—Schwegman, Lundberg & Woessner, P.A.

(57) ABSTRACT

An elevated equipment holding apparatus includes a pin; and a latch plate that engages the pin. The latch plate includes a tortuous path that directs the pin to a latching point after the latch plate is raised and then lowered a first time, and frees the pin from the latch point after the latch plate is raised and lowered a second time. The elevated equipment holding apparatus includes a capsule for holding equipment. One of the pin or the latch plate is attached to the capsule. The other of the pin or latch plate attached to a body at an elevated position. The body, in various embodiments, can be a tower, a monopole.

20 Claims, 8 Drawing Sheets

AERIE

AERIE

AERIE
Equalizer Assembly

AERIE
LIFTPLATE ASSEMBLY

AERIE
CABLE
GUIDE KNUCKLE

AERIE
CABLE
GUIDE KNUCKLE

AERIE II

Latch plate Assembly

SYSTEM FOR RAISING, LOWERING & PRECISION POSITIONING OF SURVEILLANCE, SECURITY AND COMMUNICATIONS EQUIPMENT

CROSS-REFERENCE TO RELATED APPLICATION(S)

This application claims the benefit under 35 U.S.C. § 119(e) of U.S. Provisional Patent Application Ser. No. 60/422,131, filed Oct. 30, 2002.

FIELD OF THE INVENTION

The present invention relates to monopoles and specifically to a system for raising, lowering and precision positioning of surveillance, security and communications equipment on a monopole.

BACKGROUND OF THE INVENTION

Antenna towers have been in existence since the 1920s and '30s when AM radio emerged as a popular medium of communication. There several types of towers, including guyed lattice-type towers and monopoles. Monopole towers include a tubular mast. Monopole towers are generally unable to attain the same height as the guyed, lattice-type towers, but monopole towers require less land. In addition, the monopole towers are more aesthetically appealing and, therefore, clearance for erecting these towers is generally more easily attained from government bodies, such as cities and states. Monopoles are the tower of choice for antennas used in broad-ranging communication systems, such as cellular communications systems. Currently, the antennas are fixedly mounted on top of the towers. Typically, a plurality of antennas, some transmitting antennas and some receiving antennas, are mounted on a single monopole tower. Antennas are typically mounted to a nonremovable platform at the top of the monopole tower.

Other equipment may be mounted on the platform mounted to the monopole tower. For example, surveillance or security cameras may be mounted on monopole towers and the platform. Monopole towers vary in height. In some applications, a smaller monopole is erected near a building and surveillance or security cameras are mounted thereon. The surveillance or security cameras are then used to watch at least a portion of the building. The monopole tower can be remotely located from the building. In another application, fences can be monitored using surveillance or security cameras mounted on monopoles along a fence. In some instances, both communications antennas and security equipment are mounted to monopole towers. Of course other equipment may be mounted to the monopole as well.

The equipment mounted to a monopole must be solidly mounted. The wind loads on the monopole are generally rather large. The wind load increases on a monopole as more equipment is mounted on the pole. In addition, the equipment must be mounted to the monopole so that the equipment does not shift. Generally, surveillance or security cameras can be moved using a motor or series of motors attached to a camera. Many types of antennas must be precisely positioned and stable, to either receive signals from or to transmit signals to, another point. If the antenna is slightly out of alignment, performance may suffer or the antenna may not even fulfill its function.

Periodically, equipment mounted on the monopole requires maintenance or repair. Currently, since the equipment is mounted to the top of the monopole, service technicians need to climb or use an expensive cherry-picker/man lift in order to reach the equipment to perform the necessary repair or maintenance. In many instances, a cherry-picker/man lift is rented. This is expensive, inconvenient and time consuming. Furthermore, since some monopoles may be in remote areas, it may be difficult to get cherry picker/man lifts to the site that needs service. There is also a safety concern when workers are climbing and/or performing tasks when perched far above the ground.

SUMMARY OF THE INVENTION

An elevated equipment holding apparatus includes a pin; and a latch plate that engages the pin. The latch plate includes a tortuous path that directs the pin to a latching point after the latch plate is raised and then lowered a first time, and frees the pin from the latch point after the latch plate is raised and lowered a second time. The elevated equipment holding apparatus includes a capsule for holding equipment. One of the pin or the latch plate is attached to the capsule. The other of the pin or latch plate attached to a body at an elevated position. The body, in various embodiments, can be a monopole. The latch plate further includes a first cardioid-shaped plate, and a second plate that forms a guide to direct the pin about at least a portion of the outer periphery of the cardioid-shaped plate. The latch point of the latch plate corresponds to an indentation portion of the cardioid shaped-plate between a first lobe and a second lobe of the cardioid-shaped plate. The elevated equipment holding apparatus also includes a device for lifting the capsule holding the equipment. The elevated equipment holding apparatus also includes a winch system for lifting the capsule holding the equipment. In some embodiments, at least a portion of the winch system is housed within the monopole. The winch system further includes a crank mechanism positioned to be accessed from the exterior portion of the monopole. The crank mechanism for operation of the winch system moves the capsule with respect to the monopole. In some embodiments, the crank mechanism is keyed to prevent unauthorized access to the winch system. The monopole further includes a liftplate cap attached proximate the free end of the monopole. The cap has openings therein for at least one lift cable. The cap routes the cable from a position exterior to the monopole to a position inside the monopole. In some embodiments, the winch system further includes a load equalizing assembly is located within the monopole, a winch cable, and a winch having a winch drum. One end of the winch cable is attached to the winch drum and the other end of the cable is attached to the load equalizing assembly.

A latch plate includes a first cardioid-shaped plate, and a second guide plate. The second guide plate and the first cardioid-shaped plate form a cam surface. The second guide plate is spaced from a portion of the periphery of the first cardioid-shaped plate. The first cardioid-shaped plate is asymmetrical, and includes a load bearing area corresponding to the indentation in the first cardioid-shaped plate. The latch plate also includes support straps and stand-offs. The first cardioid-shaped plate and the second guide plate are attached to the backing support straps and stand-offs.

A method for positioning equipment on a tower includes elevating an equipment capsule with a cable, passing a portion of the equipment capsule over a cam surface to a load bearing point, and relaxing the cable. Lowering the equipment capsule includes elevating the equipment capsule, and passing a portion of the equipment capsule over another cam surface beyond the load bearing point.

DETAILED DESCRIPTION OF THE INVENTION

The following description and drawings illustrate specific embodiments of the invention sufficiently to enable those skilled in the art to practice it. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the full gambit of the claims and all available equivalents. The following description is, therefore, not to be taken in a limited sense, and the scope of the present invention is defined by the appended claims.

Figure 1:
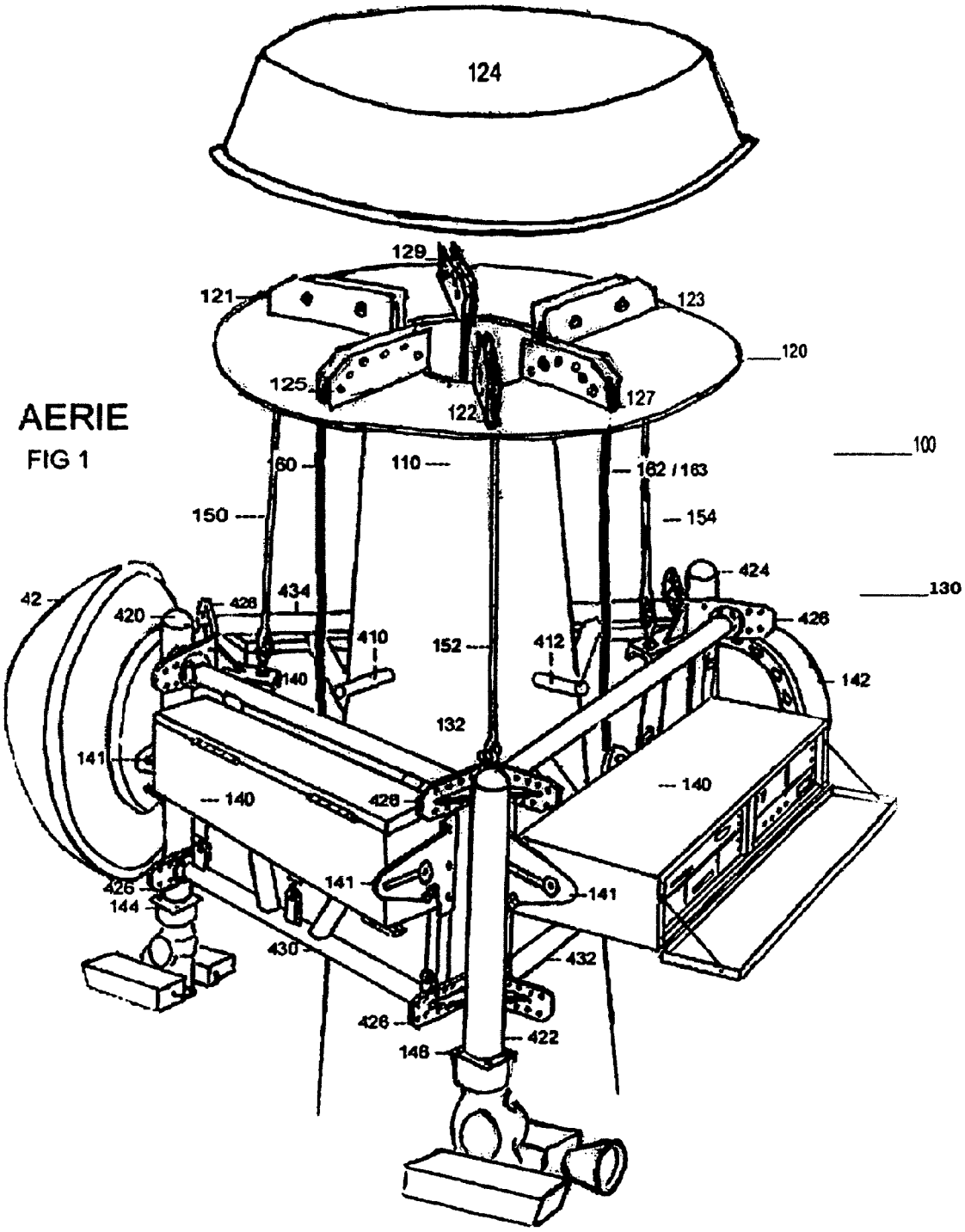
FIG. 1 is a perspective view of a monopole tower including a capsule, according to an embodiment of the invention.

FIG. 1 is a system 110 to provide elevated precision positioning of communication antennas and radio equipment, security and surveillance equipment including infrared and/or thermal imaging, video and terrestrial microwave equipment, according to an embodiment of this invention. The system 100 includes monopole 110 which has a lift plate cap 120 attached at or near the top of the monopole tower 100. The monopole includes one of the following: a single diameter pipe structure, utilizing internal flanges as required; a step tapered pipe structure utilizing, internal to external flange connections as required to reduce pipe diameters in stepped increments; or a multi-sided tapered slip-joint structure. These pipe monopoles shall be designed in accordance with tower specification TIA/EIA-222-F or other appropriate building codes to meet or exceed twist and sway tolerances for terrestrial microwave antennas.

An equipment capsule or capsule 130 is attached to the monopole antenna 110 at or near the top of the monopole tower 110 and below the lift plate cap 120. The liftplate cap 120 at the top of the monopole tower 110 has an internal set of rollers to support the power cable and/or optional fibre optic or terrestrial sensor cables during lowering and raising of the equipment capsule 130. An electrical power cable plug is disconnected during raising or lowering of the equipment capsule 130. This provides for a safer procedure since the equipment mounted to the equipment carriage or capsule is disabled or un-powered as the equipment is raised or lowered. The optional fibre optic and/or terrestrial sensor cables are "tromboned" within the body of the monopole to eliminate the need for disconnection.

The capsule 130 is a skeletal steel frame structure. The structure of the capsule 130 is lightweight and has a large carrying capacity and excellent stability. The skeletal frame of the capsule 130, in addition to providing for less weight, also provides for smaller wind loads on the capsule 130. Various equipment is attached to the capsule 130. The capsule 130 can include equipment cabinets 140, communications antennas 142, a first or camera or radar hard point 144, a second camera or radar hard point 146 and a third camera or radar hard point 148. The capsule 130 has an opening 132 therein, which is coaxial with the monopole tower 110. The system includes an external tubular skeletal equipment capsule, co-axial with, the monopole. The opening 132 is a sufficient size to allow the capsule to move up and down the length of the monopole tower 110. Attached to the equipment capsule are a number of cables 150, 152, 154. The cables are used to lift or lower the capsule 130.

As shown in FIG. 1, the capsule 130 has three sides. As a result there are three cables 150, 152, 154 that are attached to one of each of the three corners of the capsule 130. The cables are used to move the equipment capsule up and down the monopole tower 110. The cables are also used to move the capsule as it is attached to the latch plates, which is discussed in further detail below. The lift plate cap 120 includes at least three openings therein. The openings 121, 122, 123 are spaced at 120 degrees from one another about the periphery of the lift plate cap 120. The cables 150, 152, 154 pass into the openings 121, 122, 123 and then into the interior portion of the monopole tower 110. The lift plate cap 120 also includes openings 125, 127 and 129 spaced at 120 degrees from one another about the periphery of the lift plate cap 120. To accommodate, power cable 160 and a fibre optic/control cables 162 & 163 that are capable of communicating and carrying signals from the equipment attached to or on the equipment capsule 130 they also pass through the lift plate cap to the interior portion of the monopole 110. It should be noted that in FIG. 1, communication antenna 142, a communication antenna 143, and camera are attached to the capsule 130 at hard points 144, 146, 148. Each of the three equipment enclosures 140 are hinge 141 mounted to a capsule face 430, 432, 434 by a hinge 141. This facilitates access, for equipment servicing, maintenance or upgrading when the capsule 130 is in the lowered position.

This type of equipment or other types of equipment including other security and surveillance equipment or communications antennas and radio equipment as well as infrared and/or thermal imaging and video, terrestrial microwave and radar equipment can also be attached to the capsule 130.

Attached to the monopole 110 is a first latch pin 410, a second latch pin 412, and a third latch pin (not shown). The latch pins are substantially at 120 degrees away from one another located about the circumference of the monopole 110. More specifically, the latch pins are attached to the exterior surface of the monopole tower 110. The capsule 130 includes a first capsule face 430, a second capsule face 432, and a third capsule face 434. The capsule faces 430, 432, 434 are attached to one another by capsule corner weldments 420, 422, 424. Equipment may be attached to the capsule faces 430, 432, 434 or to the capsule corner weldments 420, 422, 424. The equipment is generally attached to the exterior portion or the surface of the capsule which is most distant from the monopole 110. Attached onto the various capsule faces 430, 432, 434, a first latch plate, a second latch plate, and a third latch plate. The first latch plate, second latch plate and third latch plate are not shown in FIG. 1. However, the operation of the latch plates engaging with latch pins is described with respect to FIGS. 4A and 4B.

Figure 2A:
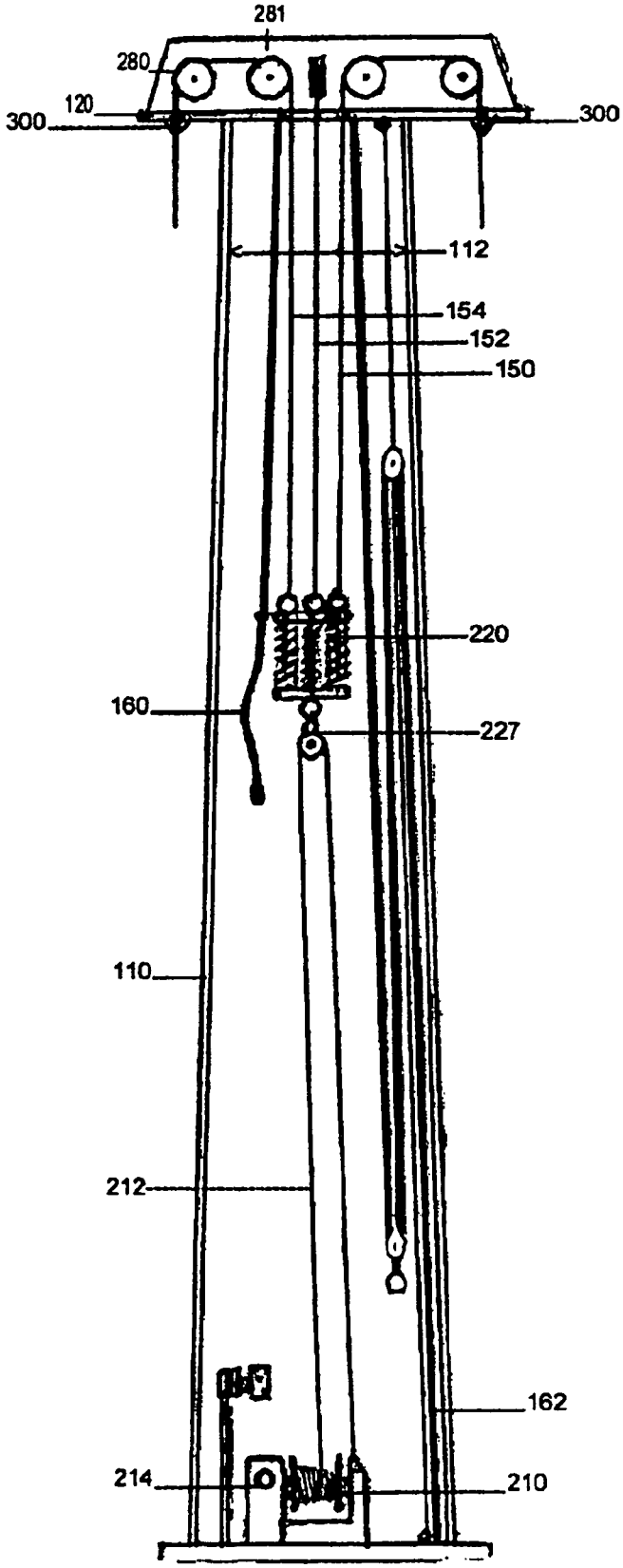
FIG. 2A is a schematic view of a winch system within the monopole tower, according to an embodiment of the invention.
Figure 2B:
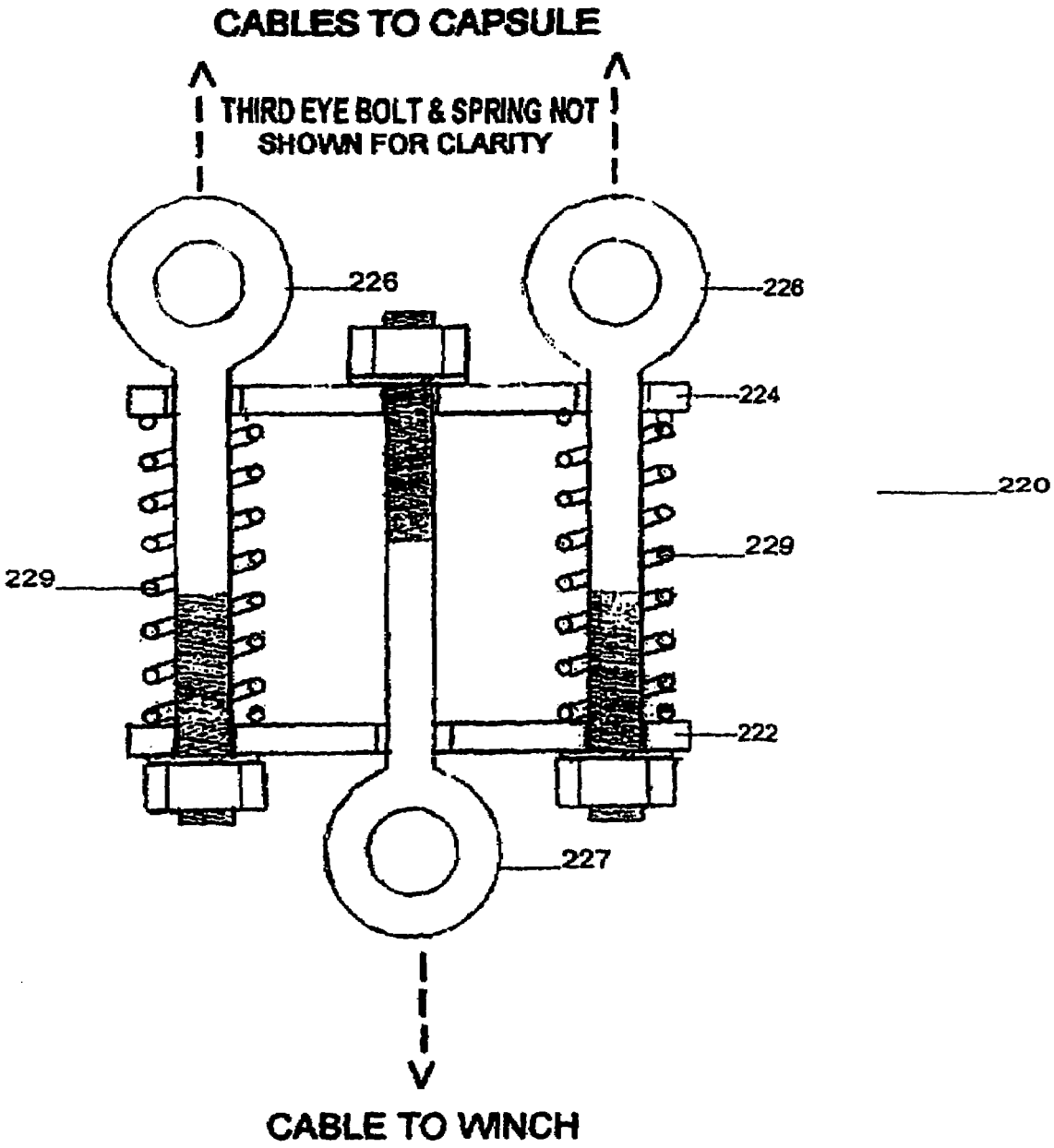
FIG. 2B is an elevation view of the equalizing assembly, according to an embodiment of this invention.

FIG. 2A is a schematic view of a winch system 200, according to an embodiment of this invention. FIG. 2B is an elevation view of an equalizing assembly 220, according to an embodiment of this invention. Now, with respect to FIGS. 2A and 2B, the winch system 200 will be detailed. The majority of the winch system 200 is housed within the monopole 110. FIG. 2A shows a partial cutaway of a monopole which shows the interior portion 112 of the monopole tower 110. The winch system includes a winch drum 210, a cable 212, equalizing assembly 220, and cables 150, 152 and 154. Cables 150, 152, 154, as mentioned earlier, are attached to the equipment capsule 130 (shown in FIG. 1). The equipment capsule 130 is not shown in FIGS. 2A or 2B for the sake of clarity. It should be noted that the ends of the cables 150, 152, 154 support the three corners of the equipment capsule 130, or are attached to the three corners of the equipment capsule 130. The other ends of the cables 150, 152, 154 are attached to the equalizer assembly 220. The equalizer assembly 220 fits within the inner diameter of the monopole 110. In other words, the equalizer assembly can be of any geometric shape, however its major dimension or largest dimension must be such that it fits within the diameter of the interior portion 112 of the monopole 110.

The equalizer assembly 220 includes a lower plate 222, an upper plate 224, a first eye bolt 226, a second eye bolt 227, a third eye bolt 228 and a fourth eye bolt, not shown. Three of the eye bolts 226, 228 and not shown have their eyes positioned near the upper plate 224. The final eye bolt 227 has its eye positioned near the lower plate 222. The upper plate 224 and the lower plate 222 are separated. Springs are positioned around the shafts of the eye bolts 226, 228 and the eye bolt not shown. The springs 226 bias the upper plate 224 from the lower plate 222. Each of the eye bolts 226, 227, 228 and not shown have a fastener on the free end opposite the eye of the eye bolt. The springs 229 absorb the slack in cables 150, 152, 154 after capsule docking is completed. The eye bolts 226, 228 and not shown are attached or are effectively attached to the lower plate 222 of the equalizer assembly 220. The eye bolt 227 is attached to the upper plate 224 of the equalizer assembly 220.

The three cables 150, 152, 154 that are attached to the equipment capsule 130 are attached to the lower plate of the equalizer assembly 220. The cable 212 is attached to the upper plate of the equalizer assembly 220. The cable 212 is connected at one end to the winch drum 210, and at the other end to the equalizer assembly 220. Therefore, by turning the winch drum 210 in a first direction, the equipment capsule 130 is raised. When the winch drum 210 is turned in the other direction, the equipment capsule 130 can be lowered. The winch drum 210 is driven by a externally applied drive motor. The winch drum 210 has a crank or crank mechanism 214 which is attached to the winch drum 210. The crank mechanism 214 is accessible through the side wall of the monopole tower 110. The crank mechanism 214 is keyed in order that only a specific drive axel will fit the crank mechanism 214. This prevents unauthorized personnel from driving the crank mechanism to either raise or lower the equipment capsule. It is also contemplated that the exterior wall of the monopole will have a secure door for allowing access to the winch drum 210 and crank mechanism 214. It is contemplated that any type of exterior motor could be used including an electric drill. It is important to note, however, that the external drive motor must be sized for the given weight of the equipment capsule.

An external, detachable electric motor or detachable hand crank provide the primary drive for the winch system. The drive shafts are socket keyed for security. In one embodiment of the invention, a winch drum with gear reduction system is used as part of the winch system. The winch drum with gear reduction system, allows control of the speed of the equipment capsule 130 as it is raised and lowered. The winch drum with gear reduction system is located at the base of the monopole 110, and is internal to the pipe monopole 110. A torque limiter is provided to prevent over driving the winch system.

Sway reducing stabilizer bogies are attached to the equipment capsule. The stabilizer bogies provide self-adjusting, shock damping, and uniform radial positioning of the equipment capsule over different monopole diameters, during the lowering and raising operations, even in adverse weather conditions.

Figure 2C:
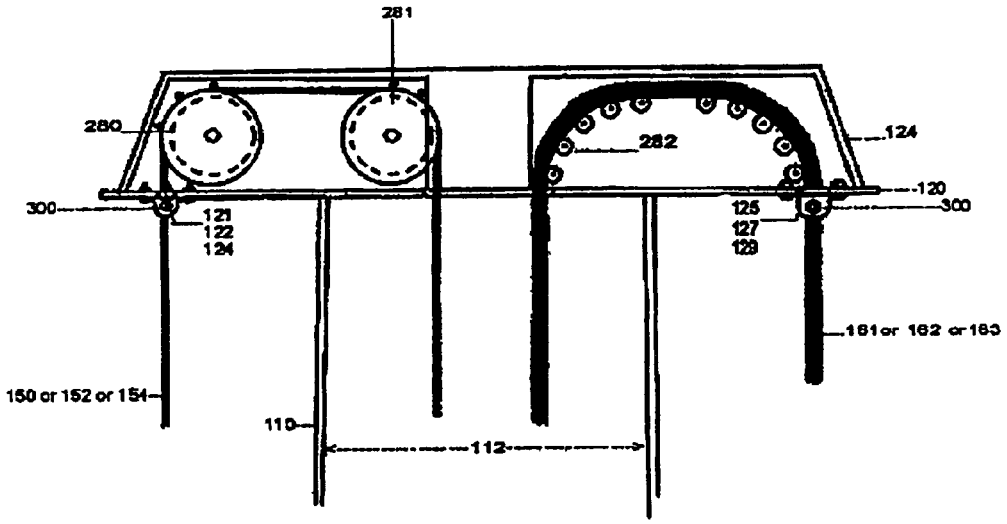
FIG. 2C is an elevation cross-sectional view of the top plate, according to an embodiment of the invention.

FIG. 2C is a schematic cross-sectional view of the lift cap 120, according to an embodiment of this invention. A liftplate cap 120 on top of the pipe monopole has an internal set of two sheaves 280, 281 for each of three lift cables placed radially at 120 degrees to each other about the pipe monopole axis. The lift cables attach, via the sheaves 280, 281, the equipment capsule to the circumference of a load equalizing assembly 220. The load equalizing assembly 220 is located inside of the pipe monopole and is attached to the free end of the winch cable by means of a swivel clevis at its center. This allows for equal forces to be applied to the three lift cables by the single winch cable, thereby balancing the equipment capsule and maintaining its horizontal and vertical axis relationship with the pipe monopole. The lift plate cap 120 includes sets of PVC rollers 282 positioned to support the arc of the Power cable 160, and the fibre optic and terrestrial sensor cables 162 as they transition from the monopole interior to the capsule equipment cabinets during lower and raise operations.

It is also worthy of noting that the lift plate cap 120 and its openings 121, 122, 124 and the openings 123, 125 for the power 160 and fibre optic/control cables 162, respectively are provided with a set of guide knuckles (detailed with respect to FIGS. 3A and 3B) which guide cables 150, 152, 154 and power 160 and fibre optic/control cables 162 and 163 through the openings 121, 122, 123, 125, 127, 129 and to the interior portion 112 of the monopole 110 so that the cables 150, 152, 154, and the power cable 160, and fibre optic/control cables 162 and 163 do not bind or prematurely wear due to deflection through the openings in the lift plate cap 120, created during docking or undocking.

Figure 3A:
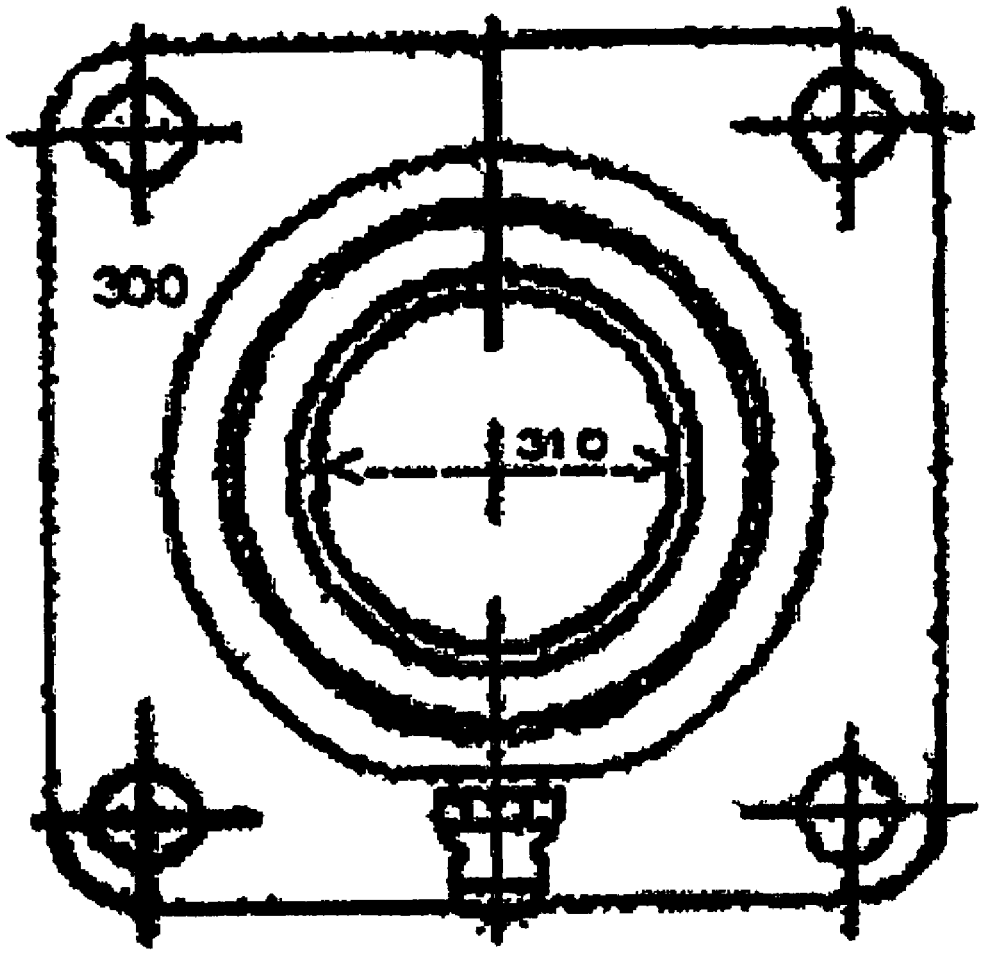
FIG. 3A is a top view of a cable guide knuckle used to route cables to positions within the monopole, according to an embodiment of the invention.
Figure 3B:
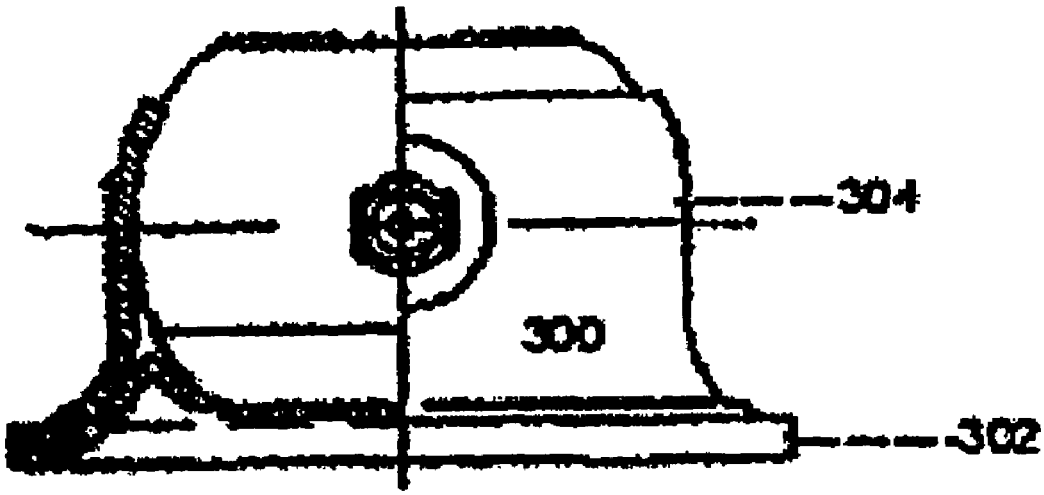
FIG. 3B is a side view of a cable guide knuckle used to route cables to positions within the monopole, according to an embodiment of the invention.

FIGS. 3A and 3B are schematic views of a guide knuckle used to route cables to the sheaves within the lift plate cap 120. The guide knuckle 300 has a shaft diameter 310, which accommodates one of the cables 150, 152, 154. Guide knuckle 300 can also have a diameter to accommodate the power and fibre optic/control cables 160, 162 and 163. The guide knuckle has a base 302 and a collar 304. The collar holds an inner knuckle which is allowed to swivel to accommodate different positions of the cable.

Figures 4A, 4B:
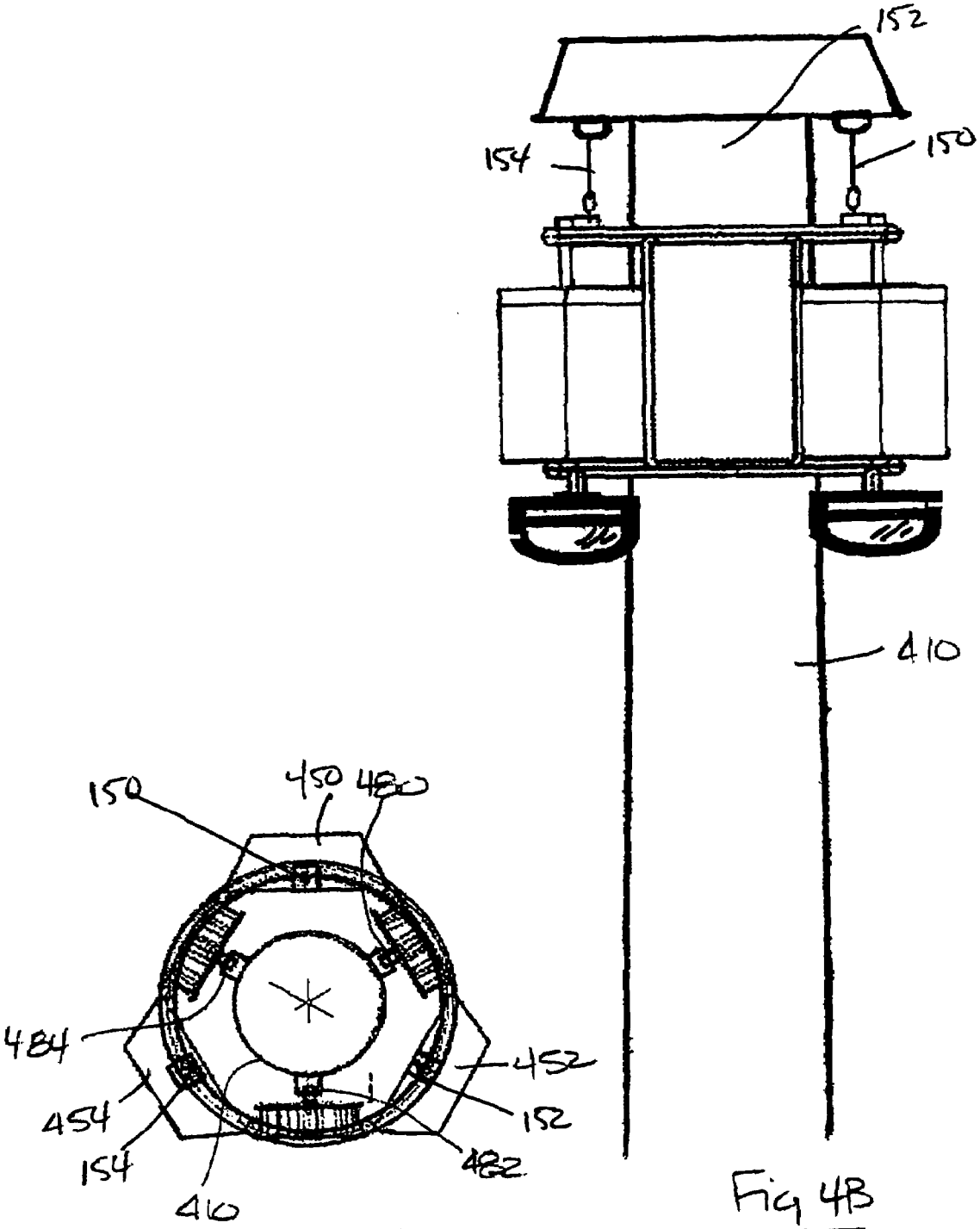
FIG. 4A is a top view of an equipment capsule attached to a monopole tower, according to an embodiment of the invention.
FIG. 4B is a side view of the equipment capsule mounted to a monopole tower, according to an embodiment of the invention.

FIGS. 4A and 4B illustrate another embodiment of the invention. FIG. 4A is a top view of an equipment capsule 440 attached to a monopole tower 410, according to another embodiment of the invention. FIG. 4B is a side view of the equipment capsule 440 mounted onto the monopole tower 410. Now referring to both FIGS. 4A and 4B, this embodiment of the invention will be discussed. Attached to the top of the monopole tower 410 is a lift cap 420. As shown in FIG. 4A, the monopole tower has been truncated. The lift plate cap 420 and the top portion of the monopole 410 have been removed to more clearly show this aspect of the invention. Attached to the monopole 410 is a first latch pin 480, a second latch pin 482, and a third latch pin 484. The latch pins are substantially at 120 degrees away from one another located about the circumference of the monopole 410. More specifically, the latch pins 480, 482, 484 are attached to the exterior surface of the monopole tower 410. The capsule 430 is cylindrical, unlike the capsule 130 that includes three capsule faces or sides (see FIG. 1). Attached to the cylindrical capsule 430 are three equipment cabinets 450, 452, 454. The equipment cabinets 450, 452, 454 are generally attached to the exterior portion or the exterior surface of the capsule most distant from the monopole 410. A first latch plate 500, a second latch plate 500', and third latch plate 500" are positioned on the capsule 120 degrees away from each other and engage latch pins 480, 482, 484. The latch pins 480, 482, 484 attached to the monopole tower 410 engage latch plates 500, 500', 500" during the lifting of the capsule. It should be noted that the invention also contemplates placing lift pins on a capsule and placing the latch plates 500, 500', 500" on the tower. Although not shown in FIG. 1, the capsule 130 includes latch plates 500, 500', 500". While the monopole 110 has latch pins attached thereto. In FIG. 1, the latch plates are attached to the faces of the capsule 130 behind the equipment cabinets. The operation of the latch pin with respect to a latch plate is substantially the same no matter what the exact orientation of the latch pin and the latch plate is. As long as a latch pin engages the latch plate the operation will be essentially the same.

Figure 5:
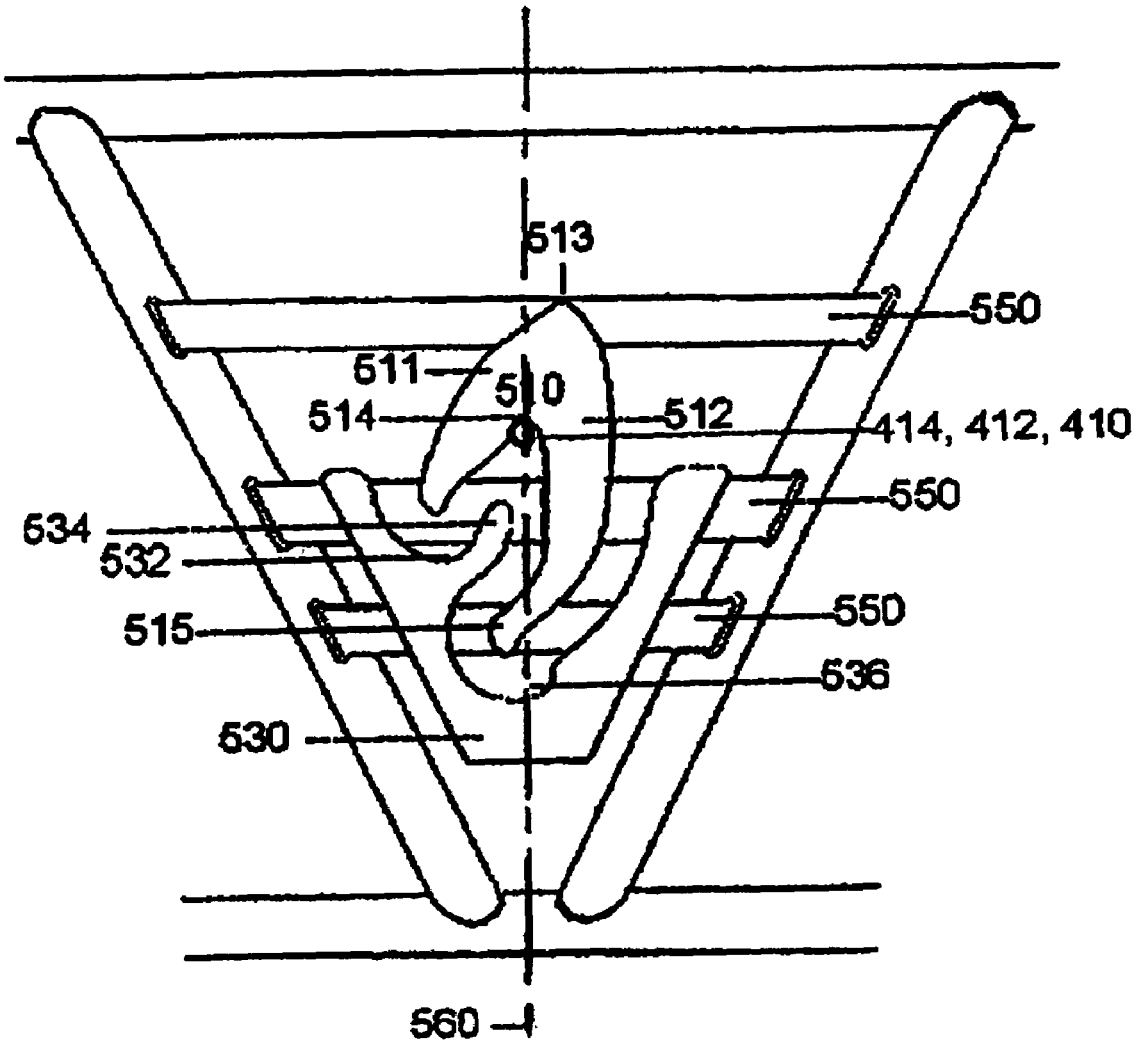
FIG. 5 is a front view of a latch plate for attaching a capsule to a tower, according to an embodiment of the invention.

FIG. 5 is a front view of a latch plate assembly 500 for attaching the capsule 130 to the tower 110 or the capsule 430 to the tower 410, according to an embodiment of this invention. The latch plate assembly 500 includes a latch plate 510, a guide plate 530, and a backing structure 550. The latch plate 510 and the guide plate 530 are placed on standoffs 502 from the backing structure 550. In other words, the latch plate 510 and the guide plate 530 are spaced away from the backing structures 550 by the standoffs, such as 502. The latch plate 510 is cardioidal or heart-shaped. The latch plate has a first lobe or first half 511 and a second lobe or second half 512. The heart-shaped or cardioidally-shaped latch plate is asymmetrical. The cardioidally-shaped latch plate has an apex 513 and an indentation point 514, which is positioned in the indentation area between the first half or first lobe 511, and the second half or second lobe 512. The latch plate or a portion of the latch plate 510 and a portion of the guide plate 530 form a guide or tortuous path for a pin, such as 410, 412, 414. The guide plate 530 and the latch plate 510 form a combined camming surface for the pin 414. The capsule is suspended by cables 150, 152, 154. The cables are positioned directly above, and attached to, the capsule corner weldments 420, 422, 424. The capsule corner weldments 420, 422, 424 are equipped with symmetrically predrilled expansion ears 426, to allow multiple attachment points for latch plate assemblies 500, this facilitates symmetrical expansion of the capsule in fixed increments to accommodate different monopole diameters.

Now looking at both FIGS. 4A, 4B and 5, the operation of the latch plate assembly 500, 500', 500" attaching to the pins 480, 482, 484 will now be discussed. It should be understood that there are latch plate assemblies attached to the capsule 430 and three pins 480, 482, 484 attached to the monopole 410. In other words, a tri-cardioidal latching mechanism attaches the equipment capsule to the latch pins at the top of the pipe monopole. This latching mechanism allows for the release of winch system tension, once docking is complete. The latching mechanism provides for repeatable and stable positioning of the equipment capsule 440 and the equipment, such as terrestrial microwave antennas and infrared and/or thermal imaging or optical devices, carried by the capsule.

When the capsule is placed into position, all three of the latch plate assemblies function the same as one of the latch plate assemblies and, therefore, only one latch plate assembly will be discussed. It should be understood that all three latch plate assemblies are undergoing similar latching processes as the one discussed. Furthermore, it should be understood that there is no requirement to have only three latch plates. Lesser or larger number of latch plates could be used to attach a capsule 440 to a tower 410.

It should be noted that the monopole need not be the one carrying the pin 480, 482, 484, and that the capsule 430 is not necessarily limited to carrying the latch plate assemblies 500, 500', 500". It is contemplated that the latch plate assemblies 500, 500', 500" could be attached either to the monopole tower 110 or to the capsule 440. Furthermore, it is contemplated that the pins 480, 482, 484 could be attached either to the monopole tower 410 or to the capsule 450. As mentioned previously, the cables 150, 152, 154 for lifting the capsule 130 are each attached to the capsule at points directly above the capsule 430.

Each latch plate assembly 500, 500', 500" has a center line 560. It should be noted that the center line 560 passes through the indentation point 514 in the latch plate 510. The apex 513 of the latch plate 510 is offset from the center line 560. As a result, when the capsule 130 is lifted into a position where the pin 414 contacts the latch plate, the initial contact point will be on the first lobe 511 side of the latch plate. Further lifting will allow the pin to ride over the first lobe and then contact a first inflection point 532 on the guide plate 530. The guide plate 530 will then prevent further lifting of the capsule 130. It should be noted that as the pin 414 rides over the first lobe 511 of the latch plate, then comes into contact with the guide plate 530 and stops its upward travel at about the inflection point 532, the whole capsule will shift slightly in a first direction. The next step is to lower the capsule. Lowering the capsule causes the pin to again eventually contact the first lobe 511 of the latch plate at the valley between the first lobe 511 and the second lobe 512. The capsule is lowered until the indentation point 514 is reached. The indentation point 514 is where the pin 414 remains while the capsule 130 stays on the monopole. Therefore, the inflection points 514 in each of the latch plate assemblies 500, 500', 500" are the attachment points between the pins 410, 412, 414 and the latch plates 510. After the pins are moved to the indentation points 514, thereby removably attaching the latch plate assemblies to the pins on the monopole, the cables 150, 152, 154 are relaxed. As a result, the cables do not carry a load while the pins 410, 412, 414 are engaged with the indentation point 514 of the latch plates 510. Springs 229 located in the equalizing assembly 220 (as shown in FIG. 2B) maintain slight tension absorbing any cable slack while the pins 484, 482, 480 are engaged with the indentation points 514 of the latch plates 510 of the various latch plate assemblies.

To remove or lower the capsule 130 from the pins 414, 412, 410, initially the cables 150, 152, 154 are used to raise the capsule 130. Raising the capsule disengages the pins 484, 482, 480 from the indentation point 514 in the latch plate 510. A finger 534 of the guide plate 530 is positioned or offset from the centerline 560. Thus, as the pin is disengaged from the indentation point, the pin rides over the surface of the second lobe or second half 512 of the latch plate and past the finger 534 and to a second inflection point 536 in the guide plate. Once the second inflection point 536 is reached, the capsule is prevented from being further raised. The capsule is then lowered and it should be noted that a point 515 of the second half or second lobe 512 is again positioned so that it is offset from the center line 560 and offset in a direction opposite the inflection point 536. Therefore, raising the capsule causes the pin 484 to ride over the outer portion of the second half or second lobe and thereby fully disengaging the latch plate 510 from the pin. The capsule 130 can then be lowered to the ground or to an area where the equipment attached to the capsule 130 can be maintained or repaired as needed. Again, as the latch is disengaged and initially raised and lowered before totally lowering the capsule, the capsule will deflect slightly in the appropriate direction.

The latch plates 510 and specifically the latch plate assemblies 500, 500', 500" have three of the cardioid latches that advantageously provide stability, safety, security and accurate position repeatability as the capsule 440 is placed into the attached position, as well as removed from the attached position. The latch plates 500,500,500 are shown for a left hand engagement application, the latch plates can be reversed for right hand engagement.

The motor used to drive the winch is detachable and has a keyed shaft for security. This allows only certain individuals to access the winch and makes unauthorized raising or lowering of the capsule very difficult. Furthermore, since the pins 484, 482, 480 carry the load rather than the cables 150, 152, 154 the capsule cannot be dropped or lowered by merely cutting the cables. A further advantage is that the winch can be manually operating using a detachable keyed hand crank. The positioning is repeatable and stable enough so that microwave antennas having any terrestrial microwave frequency will always return to their original "Path Aligned" positions. Furthermore, the equipment is arranged around and below the top of the monopole tower 110 top to reduce the visual impact and wind loading on the monopole tower 110. Wind loading is greatly reduced by using the low profile coaxially placed capsule 130, versus a large, personnel accessible, equipment support platform at the top of a monopole.

The capsule as described and indicated above uses galvanized carbon steel construction. Stainless steel, other metals, or plastics can be substituted for corrosive environments and/or light weight applications. When a plastic or other lightweight material is used additional weight may have to be attached to the capsule to assure proper operation. Generally, the weight is made of noncorrosive material.

Thus, the system for raising, lowering and positioning of equipment on a monopole provides elevated precision positioning of communications antennas and radio equipment, security and surveillance equipment such as, infrared and/or thermal imaging, video, radar and terrestrial microwave equipment. The system for raising, lowering and positioning of equipment on a monopole provides safe and secure access to the equipment, in hostile environments or by non-climbing technicians, achieved by lowering and raising the equipment capsule to do service or maintenance.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing Description of Embodiments of the Invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Description of Embodiments of the Invention, with each claim standing on its own as a separate preferred embodiment.

The invention claimed is:

1. An elevated equipment holding apparatus comprising:

a pin; and a latch plate engaging the pin, the latch plate including a tortuous path that directs the pin to a latching point after the latch plate is raised and then lowered a first time, and frees the pin from the latch point after the latch plate is raised and lowered a second time.

2. The elevated equipment holding apparatus of claim 1 further comprising a capsule for holding equipment, one of the pin or the latch plate attached to the capsule.

3. The elevated equipment holding apparatus of claim 1 further comprising a capsule for holding equipment, one of the pin or the latch plate attached to the capsule and the other of the pin or latch plate attached to a body at an elevated position.

4. The elevated equipment holding apparatus of claim 3 wherein the body is a monopole.

5. The elevated equipment holding apparatus of claim 3 wherein the body is a tower.

6. The elevated equipment holding apparatus of claim 5 further comprising a winch system for lifting the capsule holding the equipment.

7. The elevated equipment holding apparatus of claim 6 wherein at least a portion of the winch system for moving the capsule is housed within the monopole.

8. The elevated equipment holding apparatus of claim 7 wherein the winch system further comprises a crank mechanism positioned to be accessed from the exterior portion of the monopole, the crank mechanism for operation of the winch system for moving the capsule with respect to the monopole.

9. The elevated equipment holding apparatus of claim 7 further comprising a crank mechanism positioned to be accessed from the exterior portion of the monopole, the crank mechanism for operation of the winch system for moving the capsule, wherein the crank mechanism is keyed to prevent unauthorized access to the winch system.

10. The elevated equipment holding apparatus of claim 7 wherein the monopole further includes a liftplate cap attached proximate the free end of the monopole, the cap further comprising openings therein for at least one lift cable, the cap routing the cable from a position exterior to the monopole to a position inside the monopole.

11. The elevated equipment holding apparatus of claim 7 wherein the winch system further comprises;

a load equalizing plate is located within the monopole;

a winch cable; and a winch having a winch drum, one end of the winch cable attached to the winch drum and the other end of the cable attached to the load equalizing assembly.

12. The elevated equipment holding apparatus of claim 1 wherein the latch plate further comprises:

a first cardioid-shaped plate; and a second plate that forms a guide to direct the pin about at least a portion of the outer periphery of the cardioid-shaped plate.

13. The elevated equipment holding apparatus of claim 12 wherein the latch point of the latch plate corresponds to an indentation portion of the cardioid shaped-plate between a first lobe and a second lobe of the cardioid-shaped plate.

14. The elevated equipment holding apparatus of claim 1 further comprising means for lifting the capsule holding the equipment.

15. A latch plate comprising:

a first cardioid-shaped plate; and a second guide plate, the second guide plate and the first cardioid-shaped guide plate forming a cam surface wherein the second guide plate is spaced from a portion of the periphery of the first cardioid-shaped plate.

16. The latch plate of claim 15 wherein the first cardioid-shaped plate is asymmetrical.

17. The latch plate of claim 15 wherein the first cardioid-shaped plate is asymmetrically shaped and includes a load bearing area corresponding to an indentation in the first cardioid-shaped plate.

18. The latch plate of claim 15 further comprising a backing plate, the first cardioid-shaped plate and the second guide plate are attached to a backing plate.

19. A method for positioning equipment on a monopole comprising:

elevating an equipment capsule with a cable;

passing a portion of the equipment capsule over a cam surface to a load bearing point; and relaxing the cable.

20. The method of claim 19 further comprising lowering the equipment capsule which includes:

elevating the equipment capsule; and passing a portion of the equipment capsule over another cam surface beyond the load bearing point.

* * * * *